US007417518B2

(12) United States Patent
Srivastava et al.

(10) Patent No.: US 7,417,518 B2
(45) Date of Patent: Aug. 26, 2008

(54) DIELECTRIC RESONATOR

(75) Inventors: Kumar V. Srivastava, Kanpur (IN); Vishwa V. Mishra, Kanpur (IN); Animesh Biswas, Kanpur (IN)

(73) Assignee: Indian Institute of Technology, Pradesh (IN)

( * ) Notice: Subject to any disclaimer, the term of this patent is extended or adjusted under 35 U.S.C. 154(b) by 200 days.

(21) Appl. No.: 11/248,023

(22) Filed: Oct. 11, 2005

(65) Prior Publication Data

US 2006/0097826 A1 May 11, 2006

(30) Foreign Application Priority Data

Oct. 11, 2004 (IN) ..... 1972/DEL/2004

(51) Int. Cl.
*H01P 7/10* (2006.01)

(52) U.S. Cl. ..... 333/219.1; 333/202

(58) Field of Classification Search ..... 333/219.1, 333/202, 235

See application file for complete search history.

(56) References Cited

U.S. PATENT DOCUMENTS 4,706,052 A 11/1987 Hattori et al.
5,059,929 A 10/1991 Tanaka
6,882,252 B1 * 4/2005 Cros et al. ..... 333/219.1
6,965,276 B2 * 11/2005 Hasegawa ..... 333/24.2

* cited by examiner

*Primary Examiner*—Stephen E Jones
(74) *Attorney, Agent, or Firm*—Knobbe, Martens, Olson & Bear LLP

(57) ABSTRACT

A dielectric resonator is disclosed. In one embodiment, the resonator includes i) a conductive case having a plurality of walls which together define an inner space, ii) a substrate placed at the bottom of the conductive case, and iii) a cylindrical dielectric resonator unit, mounted centrally on the substrate having a central longitudinal axis. The cylindrical dielectric resonator unit includes a dumbbell shaped hole located centrally in the resonator unit extending from a top to a bottom of the resonator unit. In one embodiment, the dumbbell shaped hole includes i) a top layer, ii) a bottom layer and iii) an intermediate layer sandwiched between the top and bottom layers. In one embodiment, the substrate and resonator unit are enclosed inside the conductive case.

20 Claims, 7 Drawing Sheets

PRIOR ART PRIOR ART $D_a = a$
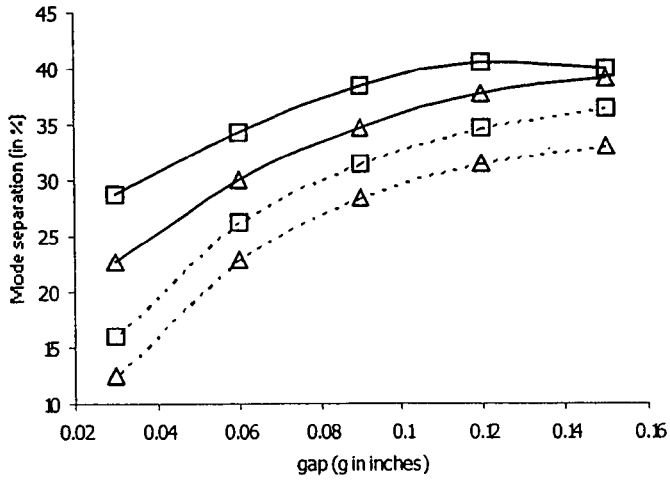
FIG. 7(a)
$D_a = 2a$
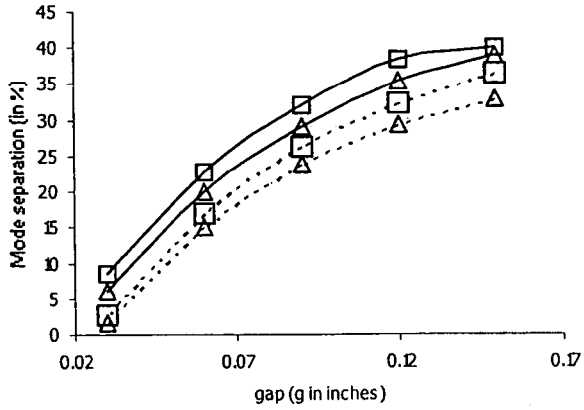
FIG. 7(b)
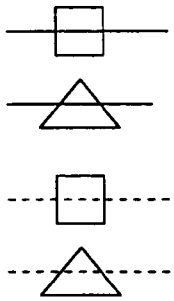
Modified Ring DR (c/a = 0.4)
Modified Riing DR (c/a = 0.3)
Ring DR (c/a = 0.4)
Ring DR (c/a = 0.3)

DIELECTRIC RESONATOR

BACKGROUND OF THE INVENTION

1. Field of the Invention

This invention relates, in general, to improved dielectric resonators wherein the spurious frequency modes are highly subsided.

2. Description of the Related Art

Microwave filters and dielectric resonator oscillators are widely used in the field of communication electronics especially in microwave telecom systems for Satellite telecom as well as terrestrial links and cellular/mobile handsets. Dielectric resonators (DRs) are key microwave passive components finding wide applications in miniature microwave filters and oscillators for generating resonating frequencies for communication. The resonance mode spectrum of a DR is so dense that the spurious (undesirable, $HE_{11}$, $HE_{12}$ or TM01δ,) modes may interfere with the dominant (desirable, usually $TE_{01\delta}$) mode. Thus it is valuable to attenuate the spurious modes for efficient transmission of the dominant (desirable) mode.

There have been several studies to improve the spurious free response of a DR configuration, while providing limited or no influence on the Q-factor for the DR.

The mode separation (in frequency) of the dominant ($f_0$, desirable) and the nearest (the undesirable) mode has been found to be 0.58 $f_0$ for a case of a ring DR shielded in a circular metal cavity. The comparative separation however tends to reduce for the DR in MIC configuration to (0.35 to 0.38)$f_0$.

U.S. Pat. No. 4,706,052 describes a design of dielectric resonator with $TE_{01\delta}$ mode being the primary mode used. The design is provided with a dielectric resonator having a plurality of dielectric resonator units which are combined into one unit by a connecting means, with a boundary being formed between adjacent dielectric resonator units. The dielectric resonator units are accommodated in a metallic conductive case with input and output members for electrical connection of said dielectric resonator with an external circuit. The design shifts a resonant frequency of spurious mode into a frequency zone higher than a resonant point by causing said spurious mode to pass through boundary surfaces or layers.

U.S. Pat. No. 5,059,929 provides a design of dielectric resonator which is constructed by piling a plurality of plate-shaped dielectrics one on the other under pressure or adhering respective dielectrics with an adhesive to each other so that faces thereof to which pressure is applied or faces thereof adhered to each other are parallel with an electric field in the dominant resonance mode of the dielectric resonator. The dielectric constant in the spaces to which pressure is applied or in the spaces in which the adhesive exists is low making it difficult for an electric field in a resonance mode other than a dominant resonance mode to pass through the spaces between the faces of the dielectrics to which pressure is applied or the faces thereof adhered to each. The spurious response is thus suppressed.

The disadvantages of the resonators of the said patents is that the mode separation changes with the change in the substrate thickness which does not provide versatility for choosing the substrate. Further, the mode separation degrades while tuning the device.

Thus there is still no dielectric resonator available in the art which efficiently generates the dominant desirable mode by subsiding the spurious modes. To fulfill this need, the present invention provides an improved dielectric resonator which overcomes all the above limitations.

SUMMARY OF CERTAIN INVENTIVE ASPECTS

Some inventive aspects described herein discuss an improved design for a configuration resulting in an improved mode separation in microwave integrated circuit (MIC) environment. The obtained mode separation in some embodiments is the best ever reported for shielded ring DR placed on a substrate. The dominant (interested) mode is $TE_{01\delta}$ and the nearest spurious mode is the $TM_{01\delta}$ or the hybrid modes. To get a better mode separation we may influence the resonance frequencies of $TM_{01\delta}$ and hybrid modes by influencing their resonance fields respectively. Accordingly, when some material from the ring DR is removed as proposed here (in FIG. 1(*c*)), the hybrid fields can be influenced more and better spurious free response could be obtained. Some embodiments of the improved DR show no deterioration Q-factor of fundamental mode as comparing to a ring DR in MIC environment. Some embodiments give mode separation that is higher over the ring DR even after changing the substrate thickness and the ratio of Q-factor of fundamental to nearest mode is also better over ring DR. Some embodiments also exhibit much lower degradation of mode separation than the conventional ring resonator while tuning and offers versatility in choosing the substrate thickness which is limited in a ring resonator.

In one embodiment the present invention provides a dielectric resonator comprising

- a conductive case having a plurality of walls which together define an inner space;
- a substrate placed at the bottom of said conductive space; and
- a cylindrical dielectric resonator unit, mounted centrally on the substrate having a central longitudinal axis, said unit comprising a dumbbell shaped hole located centrally in the said resonator unit extending from a top to a bottom of the resonator unit.
- said dumbbell shaped hole including a top $1^{st}$ layer, a bottom $3^{rd}$ layer and a $2^{nd}$ layer sandwiched between the $1^{st}$ and $3^{rd}$ layers.
- said substrate and resonator unit enclosed inside the conductive case.

In another embodiment of the present invention the $1^{st}$ layer and $3^{rd}$ layer have same depth.

In yet another embodiment of the present invention the conductive case is cylindrical in nature.

In another embodiment of the present invention the substrate is cylindrical in nature.

In still another embodiment of the present invention the $1^{st}$ layer, $2^{nd}$ layer and $3^{rd}$ layer are cylindrical in nature.

In yet another embodiment of the present invention the $1^{st}$ layer and the $3^{rd}$ layer have the same radius.

In still another embodiment of the present invention the $2^{nd}$ layer has a radius smaller than $1^{st}$ and $3^{rd}$ layers.

In another embodiment of the present invention the $1^{st}$ and $3^{rd}$ layers are cone shaped.

In still another embodiment of the present invention the $1^{st}$ and $3^{rd}$ layers are arc shaped.

In still another aspect of the present invention the conductive casing is made of a metal.

In yet another aspect of the present invention the conductive casing is gold plated.

In still another aspect of the present invention the substrate ground plane is gold plated.

In one more aspect of the present invention provides a dielectric resonator comprising:

- a cylindrical conductive case having a plurality of walls which together define inner space;

a cylindrical substrate placed at the bottom of said conductive space; and a cylindrical dielectric resonator unit, mounted centrally on the substrate having a central longitudinal axis, said unit comprising a dumbbell shaped hole located centrally in the said resonator unit extending from a top to a bottom of the resonator unit.

said dumbbell shaped hole including a top $1^{st}$ layer, a bottom $3^{rd}$ layer and a $2^{nd}$ layer sandwiched between the $1^{st}$ and $3^{rd}$ layers, the $1^{st}$ and $2^{nd}$ layers having same radius and same depth and the $2^{nd}$ layer having a radius smaller than $1^{st}$.

said substrate and resonator unit enclosed inside the conductive case.

In another aspect of the present invention $1^{st}$ and $3^{rd}$ layers are cone shaped.

In yet another aspect of the present invention the $1^{st}$ and $3^{rd}$ layers are arc shaped.

In still another aspect of the present invention the conductive casing is made of a metal.

In yet another aspect of the present invention the conductive casing is gold plated.

In still another aspect of the present invention the substrate ground plane is gold plated.

BRIEF DESCRIPTION OF THE DRAWINGS

FIG. 1(*b*) is a cross sectional diagram of a prior art Ring dielectric resonator.

FIG. 1(*c*) is a cross sectional diagram of the modified Ring resonator according to one embodiment of the present invention.

FIG. 6(*b*) Metal tuning screw with the diameter Ds for a modified ring DR.

FIG. 7(*a*) The mode separations with various positions of tuning screw for the configurations in FIG. 7 for diameter a.

FIG. 7(*b*) The mode separations with various positions of tuning screw for the configurations in FIG. 7 for diameter 2a.

FIG. 8(*b*) Cone shaped modified ring DR.

DESCRIPTION OF CERTAIN INVENTIVE ASPECTS

Certain embodiments show an improved design of a dielectric resonator wherein the spurious free response of the proposed dielectric resonator is about 6% better as compared to the conventional devices.

To get a better mode separation we need to influence the resonance frequencies of $TM_{01\delta}$ and hybrid modes by influencing their resonance fields respectively. The electric field of $TE_{01\delta}$ (fundamental mode) is basically confined near the perimeter of dielectric resonator but three other modes (undesirable, $HE_{11}$, $HE_{12}$ or $TM_{01\delta}$) are basically confined at the central region of the DR. By removing the plug from the central region in axial direction, we disturb the electric fields of only undesirable modes ($HE_{11}$, $HE_{12}$ or $TM_{01\delta}$) and influence the resonant frequencies. The resonant frequency of $TE_{01\delta}$ does not change because at the central region of DR there in no electric field due to $TE_{01\delta}$ mode.

Figures 1A, 1B, 1C:
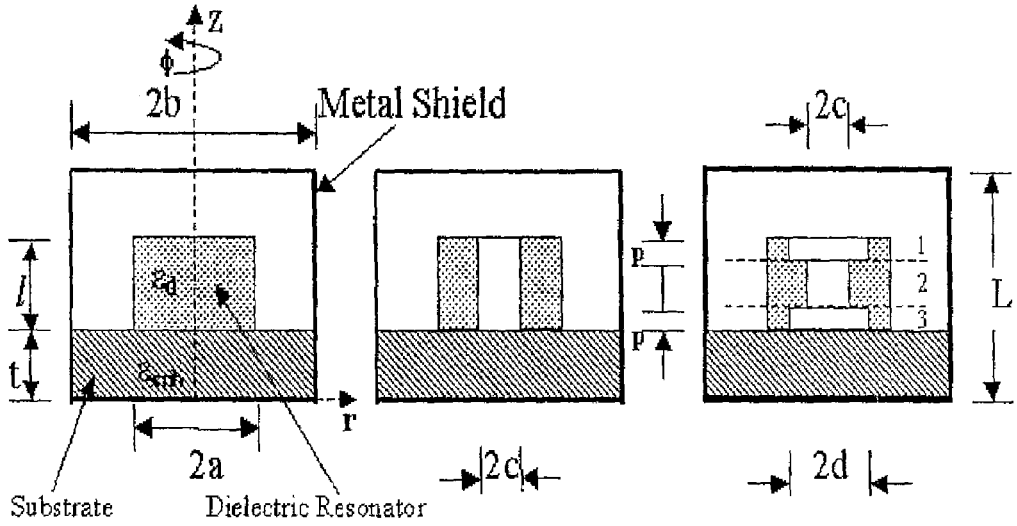
FIG. 1(*a*) is a cross sectional diagram of a prior art Circular rod dielectric resonator.

FIGS. 1(*a* and *b*) shows a prior art circular rod resonator (FIG. 1(*a*)), a ring resonator (FIG. 1(*b*)) and the proposed novel structure (modified ring resonator) FIG. 1(*c*). The ring resonator is like a circular rod resonator with the dielectric plug is removed from the central region in axial direction, to provide an improved mode separation between the dominant $TE_{01\delta}$ and the nearest higher mode.

In the modified ring resonator of FIG. 1(*c*), some dielectric is removed from the central region of the top and some from the bottom of the ring resonator in axial direction. Thus by influencing the resonance fields of this central region of top layer, the hybrid mode fields can be influenced more with lesser influence on the $TE_{01\delta}$ mode. Accordingly, when some material from the ring DR is removed as proposed here (in FIG. 1(*c*)), the hybrid fields can be influenced more.

For the given configurations in FIG. 1 the dominant (interested) mode is $TE_{01\delta}$ and the nearest spurious mode is the $TM_{01\delta}$ or the hybrid modes.

Thus the structure of FIG. 1(*c*) comprises three layers 1, 2 and 3 as shown in FIG. 1(*c*) having a hole in axial direction but only the radius of top and bottom holes are same (d) and the sandwiched layer having a different hole radius (c). The depth p of top and bottom layer is the same as shown in FIG. 1(*c*). The resonator dielectric has a radius (a) and is on substrate having ground plane, which encloses the DR. The substrate could be any material with permittivity in the range of 2.2 to 9.3. In one embodiment the permittivity is about 2.2. The material used in the present invention is RT Duride.

Figure 2:
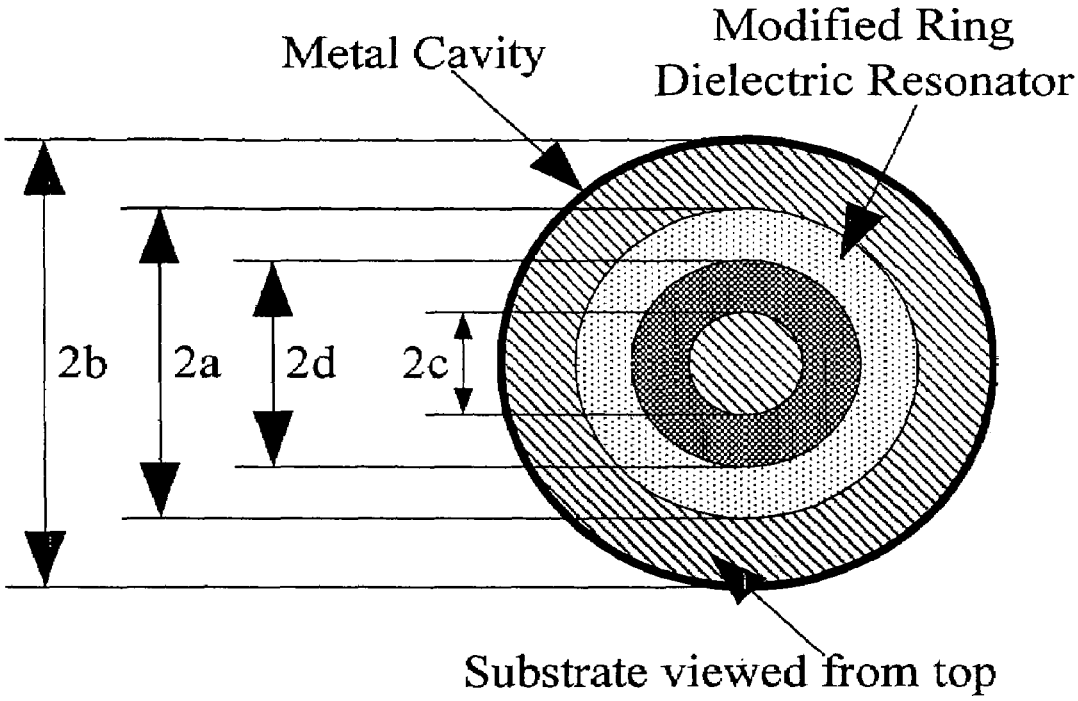
FIG. 2 is top view of a modified ring dielectric resonator.

FIG. 2 is the top view of modified ring DR.

A comparative study was done on the dominant and nearest resonance modes as well as their Q-factors for the ring resonator of FIG. 1(*b*) and the modified ring resonator of FIG. 1(*c*). The DR characteristic and other structural parameters for the configurations are provided in FIG. 1. The substrate ground plane and the metal enclosure could be of any metal having high conductivity. In some embodiments, the metal enclosure is gold plated ($\sigma=4.1\times10^7$ mhos/cm) to avoid corrosion. The unloaded Q-factor of all three resonator configurations takes into consideration the loss of the ground plane, the substrate, the dielectric resonator, the side of metal enclosure and the top and bottom cover plate. The mode separation between the dominant ($TE_{01\delta}$) mode and the nearest adjacent (hybrid or TM type) is defined by the following:

$$\text{Mode Separation(in \%)} = \left(\frac{f_{NEAREST\ MODE} - f_{TE01\delta}}{f_{TEO1\delta}}\right)\times 100.$$

Figure 3:
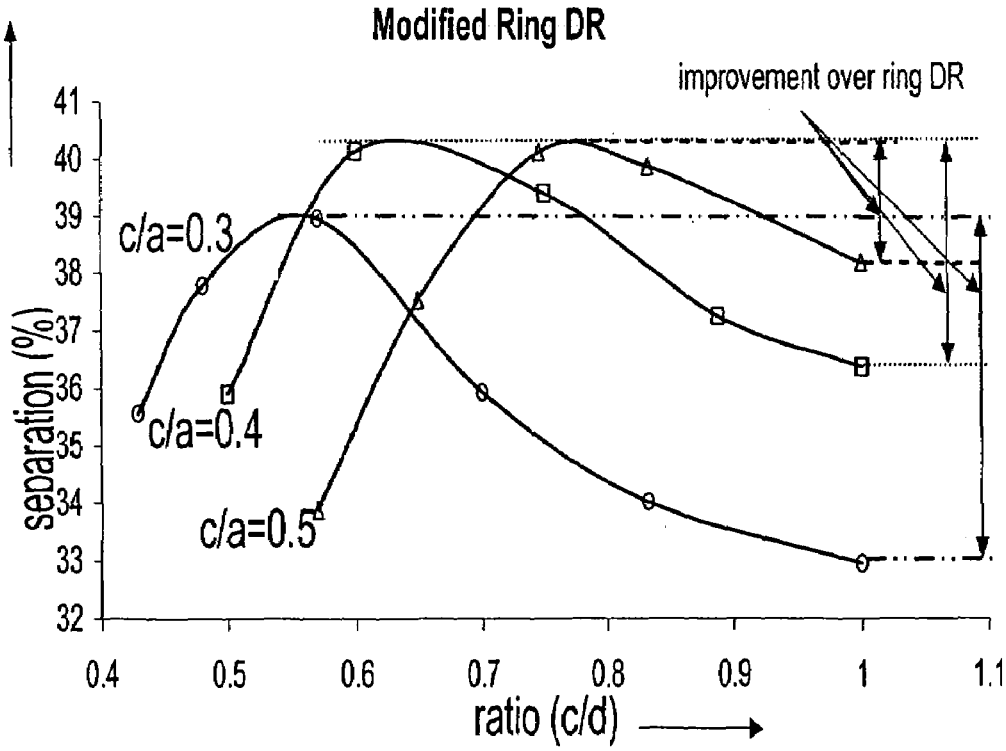
FIG. 3 shows the mode separation (in %) of $TE_{01\delta}$ with nearest mode of modified ring resonator with the variation of d shown in FIG. 1(*c*) for three particular ring radius c/a=0.3, c/a=0.4, c/a=0.5.

The resonant frequencies and Q-factors obtained in the simulations have been used for the analysis of the ring and modified ring structure. The FIG. 3 shows the separation of $TE_{01\delta}$ with the nearest mode of the modified ring resonator for the various values of the c/d ratio for the c/a range between 0.3 to 0.5. The chosen c/a range is according to the past studies of the ring resonator where the best mode separations have been observed at c/a=0.25 to 0.5. Other c/a ratios may also be used. It is seen from FIG. 3 that for various c/a ratios the maximum separation occurs at different c/d values. At c/d=1 the modified ring resonator of FIG. 1(*c*) becomes the ring resonator of FIG. 1(*b*). Hence, in the plot in FIG. 4 the maximum separation of the modified ring is being compared with ring resonator (c/d=1). The modified ring resonator always shows a better mode separation over the conventional ring resonator with improvement of 6%.

Figure 4:
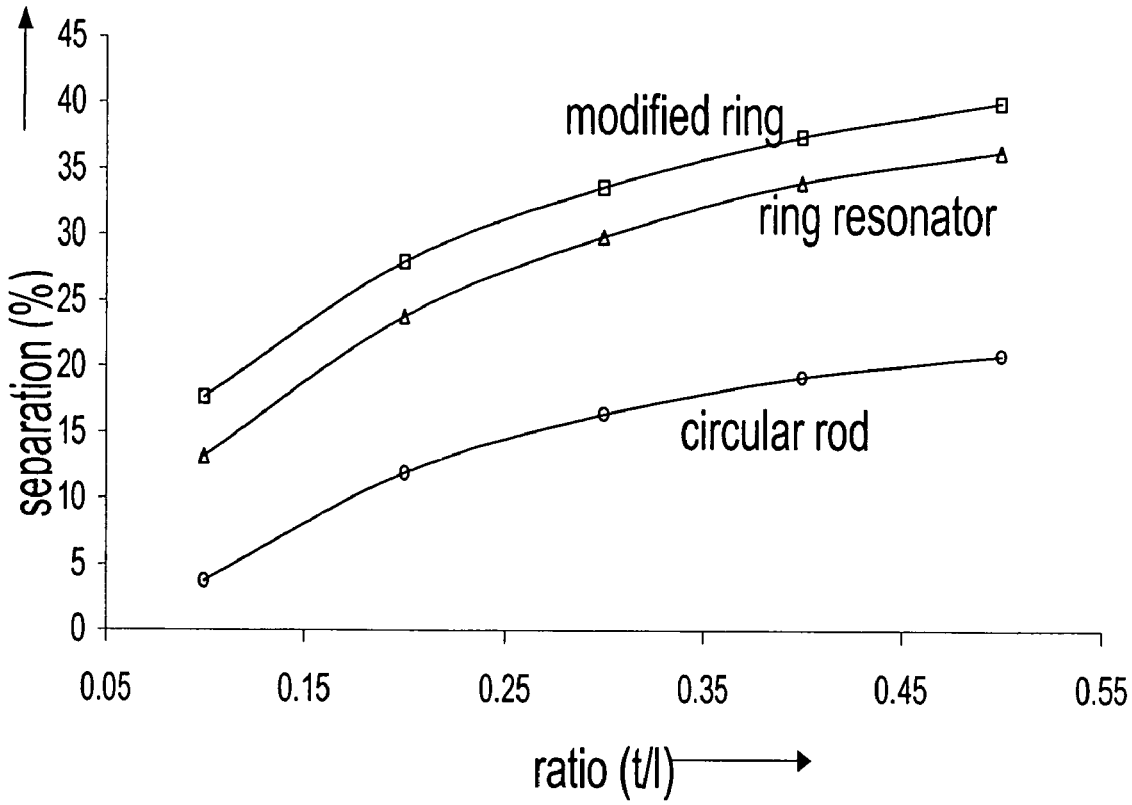
FIG. 4 gives a comparison of mode separation of $TE_{01\delta}$ mode with the nearest mode for the three configurations shown in FIG. 1 with the various substrate thickness (t). (For ring c/a=0.4, for modified ring c/a=0.4, c/d=0.6).
Figure 5:
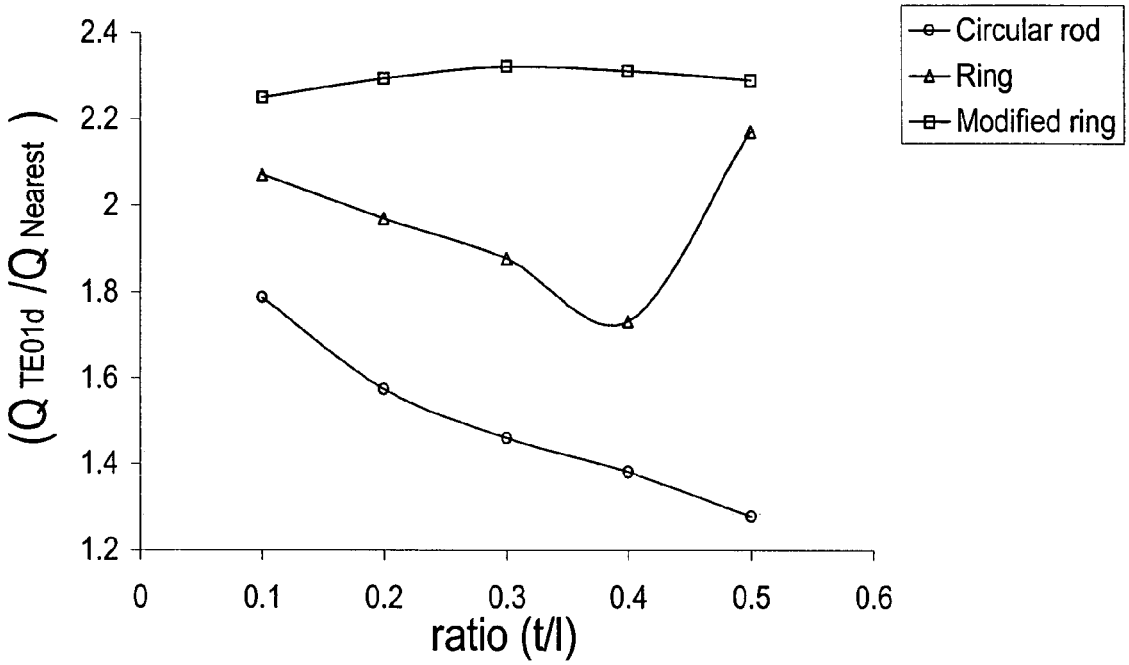
FIG. 5 shows the separation of Q-factor of $TE_{01\delta}$ mode with the nearest mode with the variation of substrate thickness (t). This plot has been derived from the data given in FIG. 5.

In the MIC environment the thickness of the substrate is an important design issue. Hence, the analysis has been carried out for various thickness (t) of the substrate. The influence of substrate thickness on mode separation for the three configurations is shown in FIG. 4. Substrate thickness is expressed here by t/l, where t is the thickness of the substrate and l is the height of the dielectric. It is evident that (i) the mode separations monotonically increase with the thickness of the substrate for all the three configurations, and (ii) the modified ring DR always gives the best mode separation compared to ring DR and circular rod for various t/l ratios. FIG. 5 shows a simultaneous evaluation of a Q-factor for these configurations at the chosen parameters (as in FIG. 4). This reveals that the Q-factor for $TE_{01\delta}$ mode do not degrade for any of the configurations. However a more remarkable observation is about the Q-factors of the nearest higher (and potentially interfering mode with the dominant) modes. $Q_{Nearest}$ for modified ring DR do not vary with substrate thickness, but for the ring it undergoes a peak at t/l=0.4 while for a rod DR it monotonically increases. This behavior for various substrate thickness implies that the energy filling factor for the interfering modes (i) increases undesirably for a rod resonator, (ii) needs to be optimized for a ring resonator, and (iii) does not influence the modified ring resonator. This result renders versatility to the modified ring DR configuration, in respect to choice of substrate thickness and may be interest in optimized filter designs.

The proposed modified ring resonator provides an improved mode separation, to an extent of 6% over a corresponding ring DR configuration in a MIC environment. A further advantage of the proposed modified ring DR is its versatility in respect to substrate thickness, for an optimized mode separation design, which for a circular rod or ring DR is not available.

Figures 6A, 6B:
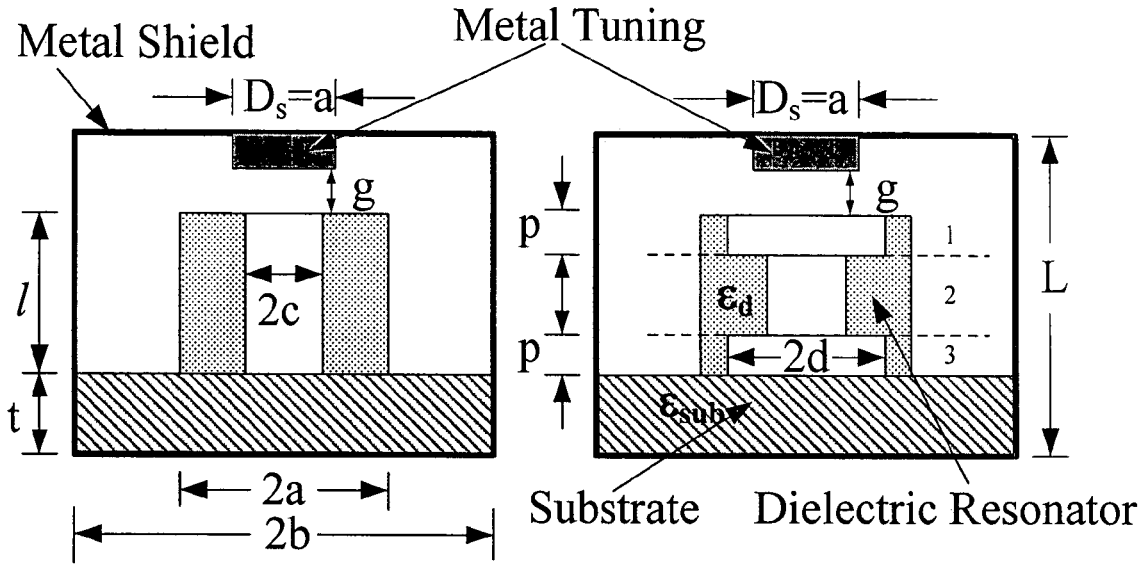
FIG. 6(*a*) Metal tuning screw with the diameter Ds for a ring DR (c/a=0.3 or 0.4).

A tuning element is an advantageous structure in a DR configuration, to compensate the shift in resonance frequencies, which appear due to the allowed fabrication tolerances, operating temperature variations and also to accommodate for the inevitable errors due to the theoretical predictions. The tunability performance for the various configurations has been examined not alone for the range of resonant frequencies the tuning can provide, but also for its influence on the mode separations. This is considered advantageous, since, a tuning metal screw tends to degrade the spurious free response. The tuning structure for the ring DR and the modified ring DR are presented in FIG. 6. The diameter of tuning screw is kept at Ds=a or Ds=2a. Evaluations for the resonant frequencies and Q-factors for the $TE_{01\delta}$ mode with the gap dimension g were done. The tunability is determined from where the frequency without tuner corresponds to maximum g value.

$$\text{Tunability} = \frac{f_{TE01\delta\max(\text{with tuner})} - f_{TE01\delta\min(\text{without tuner})}}{f_{TE01\delta\min(\text{without tuner})}} \times 100$$

The tuning range with the larger diameter screw, Ds=2a, is higher for all the configurations. Significantly, for the case of the modified ring DR configuration, where a maximum mode separation improvement had been observed, the tuning range (6.079%) is maintained close to comparative ring DR tuning range (6.335%). This advantageous aspect ensures that mode separation improvement obtained in the proposed modified ring DR, is not at the cost of tunability. On considering results of the studies done with respect to tuning effects, it was observed that while tuning ranges are generally higher for larger diameter screw, the degradation in Q-factors is also higher. However, the Q-factors in general remain higher for the modified ring case over the comparative ring DR configuration, and more so when Ds=a.

Another important object of this tunability study is regarding the behavior of mode separation with tuning. The plots (FIG. 7) show that in general the mode separations reduce with tuning for all the configurations, though to a lesser extent for the smaller diameter screw Ds=a (FIG. 7(*a*)). Further in FIG. 7(*a*), it may be seen that degradation in mode separation with reducing g (or increasing tuning) is far lesser for the modified ring DR than a comparative ring DR. The extent of degradation in mode separation, for the available tuning range has been determined from these plots (FIG. 7(*a*) & (*b*)) using a following definition $$\text{Mode Separation Degradation}(S_D) = \frac{S_{g\max} - S_{g\min}}{S_{g\max}}$$

$S_{gmax}$ is maximum mode separation (at max value of g (without tuning screw)) and $S_{gmin}$ is minimum mode separation (at min value of available g).

Obviously, a smaller $S_D$ signifies a lower degradation and hence a better spurious free response over the tunability range as may be provided in a given configuration. The modified ring DR, provides a lesser degradation in mode separation than a comparative ring DR. The degradation is found to be least (0.285) for the modified ring DR configuration for Ds=a, where tunability is 1.622%. In a comparative ring DR, the degradation SD increases twofold (0.56) with only a slightly higher tuning range (2.27%). It may also be noted that a higher tunability range can be obtained, though at the cost of higher degradation of mode separation for the case when screw Ds=2a.

Figure 8A:
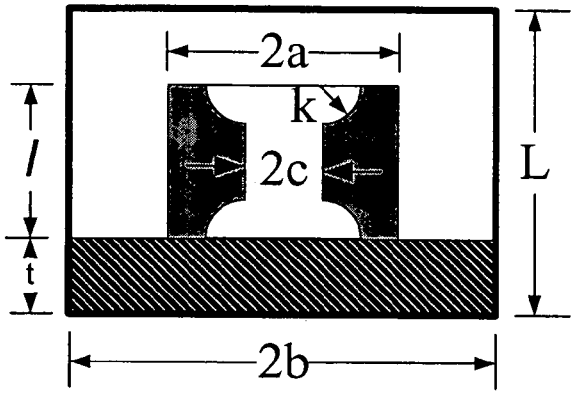
FIG. 8(*a*) Arc shaped modified ring DR.
Figure 8B:
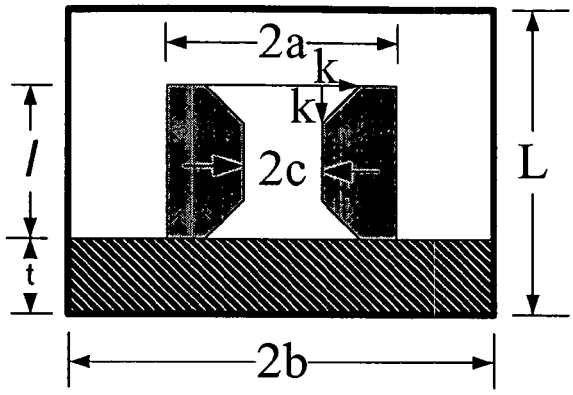

The principle used can also be applied for designing alternative designs of the dielectric resonator to provide better spurious free response. FIG. 8(*a*) shows an arc shaped modified ring resonator and FIG. 8(*b*) shows a cone shaped modified ring resonator. The following Table-1 shows the mode separations of $TE_{01\delta}$ mode with the nearest modes for the ring DR and modified ring DR of arc and cone shapes. For c/a=0.40 and k=0.75 and k=0.075. It can be easily seen that the modified ring resonator of the arc and cone types provide better mode separation.

TABLE-1

| Ring DR | | Modified Ring DR | |
|---|---|---|---|
| Parameter | Separation (in %) | Parameter | Separation (m %) |
| c/a = 0.40 k = 0.0 | 36.37 | (a) Arc shape c/a = 0.40, k = 0.075" | 40.13 |
| c/a = 0.40 k = 0.0 | 36.37 | (a) Cone shape c/a = 0.40, k = 0.075" | 39.03 |

The mode separation obtained for these embodiments is the best ever reported for shielded ring DR placed on a substrate.

ADVANTAGES

Some advantages include:

1. The modified ring DR provides a design for a dielectric resonator which provides 6% in absolute terms and 12-15% in comparative values improved mode separation as compared with the conventional devices.
2. The modified ring DR shows no deterioration Q-factor of fundamental mode as comparing to a conventional ring DR in MIC environment.
3. The modified ring DR provides a modified design of the dielectric resonator, wherein the mode separation is still higher over the conventional ring DR even after changing the substrate thickness and the ratio of Q-factor of fundamental to nearest mode is also better over the conventional ring DR.
4. The filling factor of the interfering modes does not influence the modified ring resonator for various thickness of the substrate.
5. The modified ring DR exhibits much lower degradation of mode separation than the conventional ring resonator while tuning.
6. The modified ring DR offers versatility in choosing the substrate thickness.

What is claimed is:

1. A dielectric resonator comprising:

a substantially cylindrical conductive case comprising one or more walls which define an inner space;

a substantially cylindrical substrate placed at the bottom of said inner space; and a cylindrical dielectric resonator unit, mounted centrally on the substrate comprising a substantially uniform dielectric having a central longitudinal axis, said dielectric comprising a dumbbell shaped cavity located centrally in said dielectric and extending from a top to a bottom of the dielectric, wherein said dumbbell shaped cavity includes a top layer, a bottom layer and a middle layer between the top and bottom layers, each of the top, bottom, and middle layers are bounded by the dielectric, the top and bottom layers have substantially a same radius and substantially a same depth, and the middle layer has a radius smaller than that of the top and bottom layers, and wherein said substrate and resonator unit are enclosed by the conductive case.

2. The dielectric resonator as claimed in claim 1, wherein the top and bottom layers are frustoconical.

3. The dielectric resonator as claimed in claim 1, wherein the top and bottom layers comprise an arc shape in a plane containing the central longitudinal axis.

4. The dielectric resonator as claimed in claim 1 wherein the substrate comprises a gold plated ground plane.

5. The dielectric resonator as claimed in claim 1, wherein the conductive casing comprises metal.

6. The dielectric resonator as claimed in claim 5, wherein the conductive casing is gold plated.

7. A dielectric resonator comprising:

a substantially cylindrical conductive case comprising one or more walls which define an inner space;

a substantially cylindrical substrate placed at the bottom of said inner space; and a cylindrical dielectric resonator unit, mounted centrally on the substrate, said unit comprising a substantially uniform dielectric having a cavity located centrally in said dielectric and extending from a top, through a middle, to a bottom of the dielectric, wherein said cavity comprises a first radius near the top of the dielectric, a second radius near the middle of the dielectric, and a third radius near the bottom of the dielectric, and wherein the second radius is less than the first and third radii, and wherein said substrate and resonator unit are enclosed by the conductive case.

8. The dielectric resonator as claimed in claim 7, wherein the first radius is substantially equal to the third radius.

9. The dielectric resonator as claimed in claim 7, wherein said cavity comprises at least one of a frustoconical layer near the top of the dielectric, a frustoconical layer near the middle of the dielectric, and a frustoconical layer near the bottom of the dielectric.

10. A dielectric resonator comprising:

a conductive case comprising one or more walls which define an inner space;

a substrate placed at the bottom of said inner space; and a cylindrical dielectric resonator unit, mounted centrally on the substrate comprising a substantially uniform dielectric having a central longitudinal axis, said dielectric comprising a dumbbell shaped cavity located centrally in said resonator unit and extending from a top to a bottom of the dielectric, wherein said dumbbell shaped cavity includes a top layer, a bottom layer and a middle layer between the top and bottom layers, each of the layers being bounded by the dielectric, wherein the top and bottom layers comprise an arc shape in a plane containing the central longitudinal axis, and wherein said substrate and resonator unit are enclosed by the conductive case.

11. The dielectric resonator as claimed in claim 10, wherein the substrate is substantially cylindrical.

12. A dielectric resonator comprising:

a conductive case comprising one or more walls which define an inner space;

a substrate placed at the bottom of said inner space; and a cylindrical dielectric resonator unit, mounted centrally on the substrate comprising a substantially uniform dielectric having a central longitudinal axis, said dielectric comprising a dumbbell shaped cavity located centrally in said resonator unit and extending from a top to a bottom of the dielectric, wherein said dumbbell shaped cavity includes a top layer, a bottom layer and a middle layer between the top and bottom layers, each of the layers being bounded by the dielectric, wherein the top and bottom layers are frustoconical, and wherein said substrate and resonator unit are enclosed by the conductive case.

13. The dielectric resonator as claimed in claim 12, wherein the top layer and bottom layers have substantially same depth.

14. The dielectric resonator as claimed in claim 12, wherein the conductive case is substantially cylindrical.

15. The dielectric resonator as claimed in claim 12, wherein the substrate is substantially cylindrical.

16. The dielectric resonator as claimed in claim 12, wherein the top layer, the middle layer and the bottom layer are each substantially cylindrical.

17. The dielectric resonator as claimed in claim 12, wherein the top layer and the bottom layer have substantially the same radius.

18. The dielectric resonator as claimed in claim 12, wherein the middle layer has a radius smaller than top and bottom layers.

19. The dielectric resonator as claimed in claim 12, wherein the conductive casing comprises metal.

20. The dielectric resonator as claimed in claim 19, wherein the conductive casing is gold plated.

* * * * *